US007311174B2

(12) United States Patent
Hayakawa et al.

(10) Patent No.: US 7,311,174 B2
(45) Date of Patent: Dec. 25, 2007

(54) CLOTH FOR LOUDSPEAKER DIAPHRAGM, LOUDSPEAKER DIAPHRAGM, AND LOUDSPEAKER

(75) Inventors: Junichi Hayakawa, Kawasaki (JP); Takaharu Ichiryu, Osaka (JP)

(73) Assignee: Kabushiki Kaisha Kenwood, Tokyo (JP)

( * ) Notice: Subject to any disclaimer, the term of this patent is extended or adjusted under 35 U.S.C. 154(b) by 963 days.

(21) Appl. No.: 09/890,863

(22) PCT Filed: Dec. 14, 2000

(86) PCT No.: PCT/JP00/08866

§ 371 (c)(1),
(2), (4) Date: Aug. 7, 2001

(87) PCT Pub. No.: WO01/45461

PCT Pub. Date: Jun. 21, 2001

(65) Prior Publication Data

US 2002/0160678 A1 Oct. 31, 2002

(30) Foreign Application Priority Data

Dec. 15, 1999 (JP) ..... 11-356414

(51) Int. Cl.
*D03D 15/00* (2006.01)
*G10K 13/00* (2006.01)
*H04R 11/02* (2006.01)

(52) U.S. Cl. ..... 181/169; 181/196; 381/426; 381/428; 442/217; 139/420 R

(58) Field of Classification Search ..... 139/420 R; 442/217
See application file for complete search history.

(56) References Cited

U.S. PATENT DOCUMENTS 4,856,110 A * 8/1989 Giesick ..... 2/22
4,918,912 A * 4/1990 Warner ..... 442/199
4,936,085 A * 6/1990 Kolmes et al. ..... 57/229
5,233,821 A * 8/1993 Weber et al. ..... 57/224

FOREIGN PATENT DOCUMENTS

JP 02-057096 2/1990
JP 09-107595 4/1997
JP 10-257587 9/1998

OTHER PUBLICATIONS

RD 354039 A English Abstract, Oct. 10, 1993.*
RD 35439 "Uses for PBO Fiber" Complete Article. Oct. 1993.*
Official Action, Japanese Patent Office, Aug. 22, 2003 with English Translation.

* cited by examiner

*Primary Examiner*—Jenna Befumo
(74) *Attorney, Agent, or Firm*—Eric J. Robinson; Robinson Intellectual Property Law Office, P.C.

(57) ABSTRACT

In a diaphragm for a loud-speaker of the present invention, an increase in tensile strength is averagely attained as a whole, and the over all diaphragm is uniformly colored without showing any lattice pattern. The diaphragm includes a woven fabric comprising yarns made from a blend of a plurality of fibers wherein at least one of the plurality of fibers is PBO (poly(p-phenylene benzobisoxazole)) fiber.

4 Claims, 5 Drawing Sheets

(A)

(B)

(A)

(B)

(A)

(B)

(A)

(B)

CLOTH FOR LOUDSPEAKER DIAPHRAGM, LOUDSPEAKER DIAPHRAGM, AND LOUDSPEAKER

TECHNICAL FIELD

The present invention relates to a woven fabric for a loud-speaker diaphragm, a diaphragm for a loud-speaker and a structure of a loud-speaker, and particularly to a structure of threads that constitutes the woven fabric used for the diaphragm of the loud-speaker.

BACKGROUND ART

FIG. 7 is a figure showing a structure of a conventional woven fabric for the loud-speaker diaphragms. A woven fabric 10 used for the diaphragm of the loud-speaker comprises threads 11 and 12 made of a single material. Although in a certain case these threads 11 and 12 may be made of a material of one kind, in some cases a fabric may be woven using two or more kinds of materials as shown in FIG. 7. As a variation of a method for manufacturing the woven fabric 10 for the loud-speaker diaphragms, the woven fabric is obtained by weaving threads 11 and 12 of different kind. As a material of the threads 11 and 12, glass, polyester or polypropylene is usually used.

The woven fabric is wholly colored with pigments or dyestuffs in a coloring process of the woven fabric 10 for the loud-speaker diaphragm manufactured by using fibers of the threads 11 and 12 of different kind. Moreover, in the case where the threads 11 constituting the woven fabric 10 for the loud-speaker diaphragm are already colored threads 11 (a glass fiber, a polyester fiber or a polypropylene fiber), the resulting woven fabric is not further colored, but the original color of the threads 11 is represented as a color of the woven fabric 10.

In addition, PBO (poly(p-phenylene benzobisoxazole)) fiber is sometimes employed for threads 12 and interwoven with a glass fiber, a polyester fiber 11 or a polypropylene fiber in order to increase a strength of the woven fabric 10 covering a surface. In this case, several threads 11 and 12 are alternately interwoven into this fabric as shown in FIG. 7.

When two or more kinds of threads 11 and 12 are interwoven into plain fabric to obtain the conventional woven fabric 10 for the loud-speaker diaphragm, because, for example, the threads 11 and 12 may not be dyed into the same color, sometimes the resultant colors of the threads 11 and 12 may be different from each other. There is caused problem that the appearance is adversely affected by a lattice pattern formed in the woven fabric 10 for the loud-speaker diaphragm because of the above described different coloring. On the other hand, in the case where original color of the threads 11 and 12 of different kind is represented without carrying out any dyeing treatment, although omission of dyeing process is advantageous, the resultant lattice pattern appears to be more remarkable.

It is preferable that the woven fabric is colored after the woven fabric 10 is woven so that a lattice pattern will not appear in the color of the woven fabric 10 for the loud-speaker diaphragm. However, since this woven fabric 10 is used for the surface of the diaphragm of the loud-speaker, it is required that the woven fabric 10 itself has a tensile strength higher than a specific value. Therefore it is desirable to employ a PBO material that has the high tensile strength and enough durability against vibration of the loud-speaker.

However, when the PBO fiber is woven into the fabric, the above described problem of formation of the lattice pattern becomes more noticeable. The PBO fiber has a characteristic that the PBO fiber itself is difficult to be colored and has originally golden color that gradually changes into amber by being exposed to light. For this reason, in a coloring process, only a method of adding pigments having a color deeper than original color of the PBO fiber is employable. When this colored PBO fiber is interwoven into woven fabric together with other fibers (a glass fiber, a polyester fiber or a polypropylene fiber), it may provide in a finished fabric a clear lattice pattern because each fibers are colored to the different extent.

The present invention provides a solution for the above described problem. Therefore the object of the present invention is to provide the woven fabric for the loud-speaker diaphragm with increased tensile strength in which no lattice pattern is formed even with use of plural and different kinds of fibers, and to provide the loud-speaker diaphragm using the woven fabric and the loud-speaker having the diaphragm covered with the woven fabric.

DISCLOSURE OF THE INVENTION

In order to attain the above described object, the woven fabric for the loud-speaker diaphragm of the present invention is manufactured with the fabric woven with threads of the plural kinds of fibers, and at least one of the plural kinds of fibers is the fiber with poor dye-affinity such as PBO (poly(p-phenylene benzobisoxazole)) fiber.

These fibers of the plural kinds may not be made of a same material and sometimes diameter of the fibers may be different from each other. In this case, although the colors of the dyed fibers are different from each other because of a different coloring property of the fibers, threads itself made of the plural fibers show a specific color. Therefore, lattice pattern does not appear in the fabric woven with the threads.

Moreover, the tensile strength of the threads is improved by using the PBO fiber for one of the threads for the woven fabric. Even if PBO fiber with a color different from colors of other fibers is mixed in such threads, the lattice pattern does not appear in the resultant woven fabric. In addition, according to the present invention, improvement in the tensile strength is not localized but the strength is uniformly improved all over the woven fabric as compared to a conventional woven fabric.

Moreover, in addition to the above described configuration the threads comprising the plural kinds of fibers are employed in a form of a twisted yarn, a ply yarn, a core yarn, a covered yarn or an intermingled yarn. In using such threads, plural finer threads than usually used for weaving are used to form threads with usual diameter, so both the woven fabric of more uniform coloring and higher tensile strength are obtained.

In addition, in the woven fabric for the loud-speaker diaphragm of the present invention, at least one of the fibers other than the fiber with poor dye-affinity among the plural fibers making up the threads is colored with dyestuffs or pigments. A desired color can be realized without being dyed in the stage of woving fabric by containing a colored fiber in the threads. For this reason, the dyeing process after woven can be omitted.

In addition, it is preferable that the colored fiber is made up of glass, polyester or polypropylene. A glass fiber, a polyester fiber and a polypropylene fiber are low cost fibers. Cost of the woven fabric may be controlled low by using the glass fiber, the polyester fiber or the polypropylene fiber as fibers of plural kinds.

Next, in the diaphragm for the loud-speaker of the present invention, the above described woven fabric for the loud-speaker diaphragm is used in at least one part of the diaphragm. By using this woven fabric for the diaphragm of the loud-speaker, the diaphragm for the loud-speaker that is uniformly colored on the whole without the lattice pattern and, moreover, has high tensile strength is obtained.

Furthermore, in the first aspect, the loud-speaker of the present invention has the diaphragm for the loud-speaker in which the above described woven fabric for the loud-speaker diaphragm (aside from a colored fabric by dyeing) is processed after colored. In addition, in the second aspect, the loud-speaker of the present invention comprises the diaphragm for the loud-speaker which is made up of the above described woven fabric for a loud-speaker diaphragm colored by a process such as dyeing and processed without any other coloring process.

Moreover, in the loud-speaker of the present invention, preferably the above described diaphragm for the loud-speaker is used, and uniform color which is provided in the stage of weaving process is given to the woven fabric on the whole without a lattice pattern and this uniform color is displayed as the color of the diaphragm. Because the threads comprise fibers of plural kinds even if the threads are dyed after woven into the fabric, the fabric can be uniformly colored without the lattice pattern. In addition, such a coloring method does not require time and effort, and even if there is original color of the PBO fiber the lattice pattern is not displayed. Besides, since it becomes possible that a fiber with a high tensile strength such as a PBO is mixed in plural fibers, a high tensile strength as a diaphragm can be obtained. As a result, the loud-speaker obtained can support a high output.

On the other hand, when the above described diaphragm for loud-speaker of the invention is used without a dyeing process which should be done in the stage of woven process, the color which is the color derived from any one or hybrid of the fibers of plural kinds making up weaving threads is displayed as the color of the diaphragm. By such a method described above, even if a dyeing process is omitted after woven, the loud-speaker with the diaphragm having uniform color and good tone is provided. By this method, the diaphragm of low cost is provided because the manufacturing process is simplified and, the diaphragm satisfying increases in both tensile strength and uniform coloration is obtained threads of the woven fabric comprise the plural fibers. And as a result, it becomes possible to provide the loud-speaker with low price and good appearance.

BEST MODE FOR CARRYING OUT THE INVENTION

Hereinafter, detailed description about preferred embodiments of the present invention will be given referring to drawings.

Figure 1:
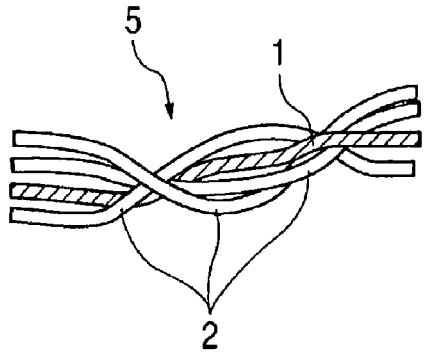
FIG. 1 is one example of threads making up the woven fabric for the loud-speaker diaphragm of an embodiment of the present invention, and it shows a structural figure of twisted yarn in which multifilaments of plurality of kinds are twisted. (A) is a partial plane view and (B) is a sectional view.
Figure 1:
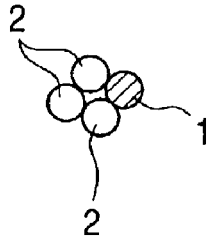
Figure 2:
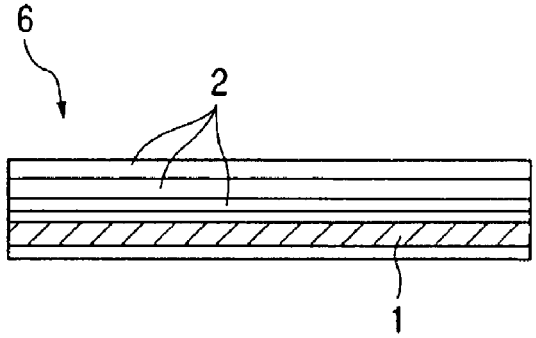
FIG. 2 is other example of threads making up the woven fabric for the loud-speaker diaphragm of an embodiment of the present invention, and it shows a structural figure of ply yarn in which multifilaments of plural kinds are plied. (A) is a partial plane view and (B) is a sectional view.
Figure 2:
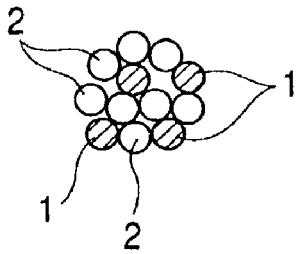
Figure 3:
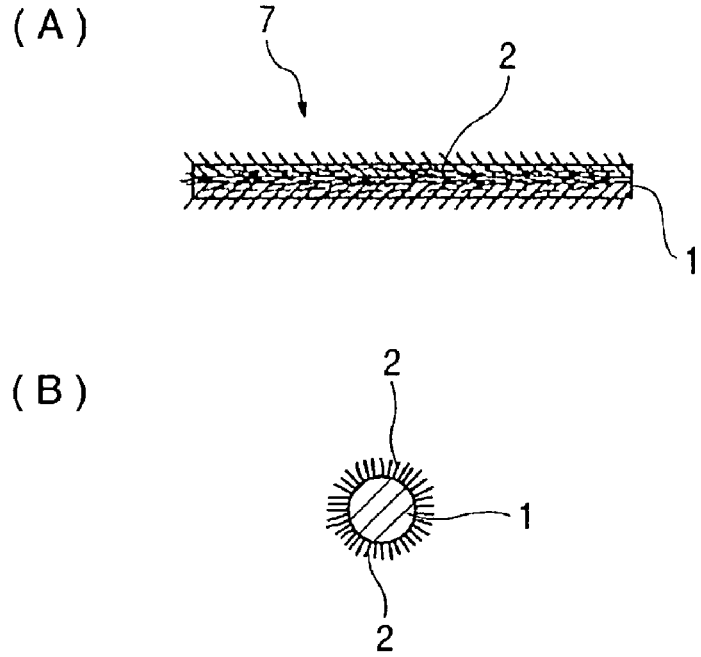
FIG. 3 is other example of threads making up the woven fabric for the loud-speaker diaphragm of an embodiment of the present invention, and it shows a structural figure of core yarn in which multifilaments of the plural kinds are combined. (A) is a partial plane view and (B) is a sectional view.
Figure 4:
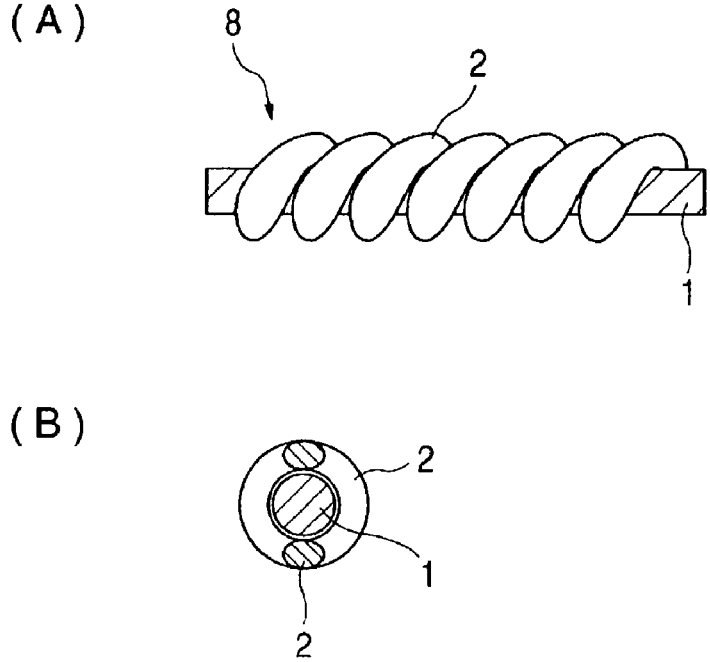
FIG. 4 is other example of threads making up the woven fabric for the loud-speaker diaphragm of an embodiment of the present invention, and it shows a structural figure of covered yarn in which multifilaments of the plural kinds are combined. (A) is a partial plane view and (B) is a sectional view.
Figure 5:
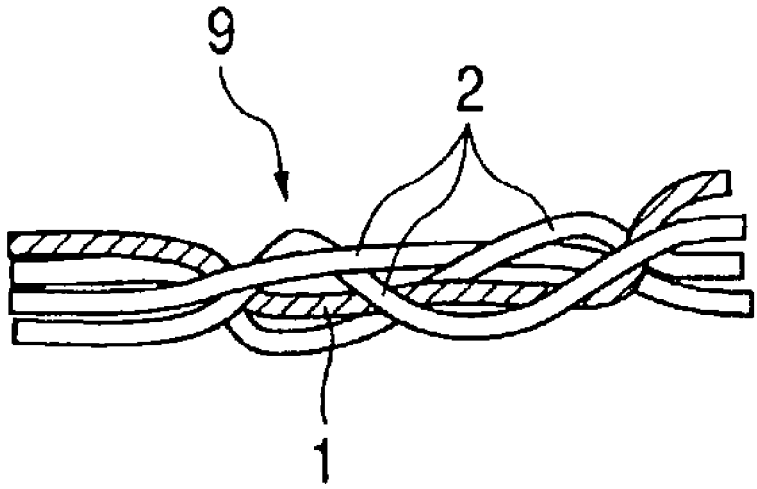
FIG. 5 is other example of threads making up the woven fabric for the loud-speaker diaphragm of an embodiment of the present invention, and it shows a structural figure of intermingled yarn in which multifilaments of the plural kinds are intermingled. (A) is a partial plane view and (B) is a sectional view.
Figure 5:
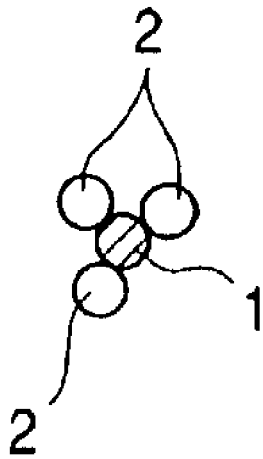

FIGS. 1 to 5 show a structure of threads constituting the woven fabric for the loud-speaker diaphragm used for the diaphragm for the loud-speaker of the present invention. Threads used in a preferred embodiment of the present invention comprise two kinds of multifilaments. As the two kinds of multifilaments here, a polyester fiber and the PBO fiber are employed. FIG. 1 shows a twisted yarn 5 obtained by combining two kinds of multifilaments, FIG. 2 shows ply yarn 6, FIG. 3 shows core yarn 7, FIG. 4 shows covered yarn 8 and FIG. 5 shows intermingled yarn 9.

As is shown in FIGS. 1 (A) and (B), one thread comprises four multifilaments combined and twisted together in order to provide a twisted yarn 5. These four multifilaments comprise one PBO fiber 1 and three polyester fibers 2 twisted together. In the twisted yarn 5 of the preferred embodiment of the present invention, 250 denier of PBO fiber 1 and 210 denier of polyester fiber 2 are employed. Then, about 1,000 denier of twisted yarn 5 is obtained.

The PBO fiber 1 is mixed into polyester fiber 2 by weaving this twisted yarn 5 into fabric, and a woven fabric is obtained in which the color of PBO fiber 1 cannot be distinguished clearly. Even if the color of the dyed PBO fiber 1 is different from the color of the dyed polyester fiber 2 when the woven fabric is dyed in this stage, the lattice pattern does not appear in the woven fabric.

In addition, the polyester fiber 2 may be colored beforehand. In this case, although the color of the one PBO fiber 1 is partially observed in the four monofilaments, the whole color of the twisted yarn 5 in itself become identical with the color of the polyester fiber 2 because the color of the twisted yarn 5 is ruled over by that of the polyester fiber 2 occupying most of the twisted yarn 5 owing to the existence of three polyester fibers 2 that are colored in the same color. As a result the color of the polyester fiber 2 is observed as the whole twisted yarn. It is preferable that the polyester fiber 2 is dyed golden color so that the color of PBO fiber 1 observed partially is not clearly distinguished.

Thus, since the fabric is woven using the twisted yarn 5 made of the colored polyester fiber 2, the color of the PBO fiber 1 is mixed into that of the polyester fiber 2 and the color of the PBO fiber 1 may not be observed visually. In the finished fabric, the color of the polyester fiber 2 is observed as the color of the fabric itself. Accordingly, there is no previous fault that a lattice pattern occurs owing to threads made of PBO fiber 1.

In addition, in the case of selecting a colored multifilament, the threads using this multifilament may be used as colored threads without any other coloring process. Thus when the threads are woven into the woven fabric for the loud-speaker diaphragm, the color of the thread becomes identical with the color of the woven fabric, and as a result a operation procedure is simplified because the coloring process after weaving step can be omitted In the embodiment of the present invention, because the woven fabric is formed by the twisted yam 5 in which the PBO fiber 1 with high tensile strength is mixed and twisted together, an effect of more uniform increase in tensile strength is achieved in the whole woven fabric as compared with the conventional fabric in which the several PBO fibers and other fibers are inter woven alternately. When this fabric is used for the diaphragm, not only an extension of a life time is achieved but an application to the loud-speaker with higher output becomes possible.

Figure 6:
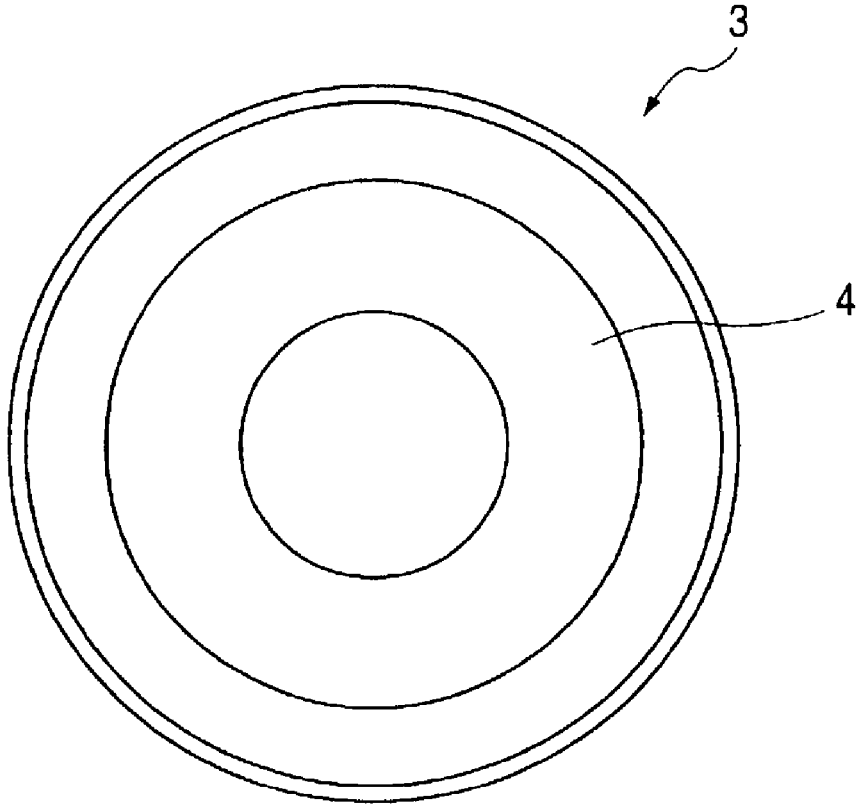
FIG. 6 is a figure showing an example of the diaphragm for the loud-speaker of the present invention used in the loud-speaker, and (A) is a plane view and (B) is a sectional view.
Figure 6:
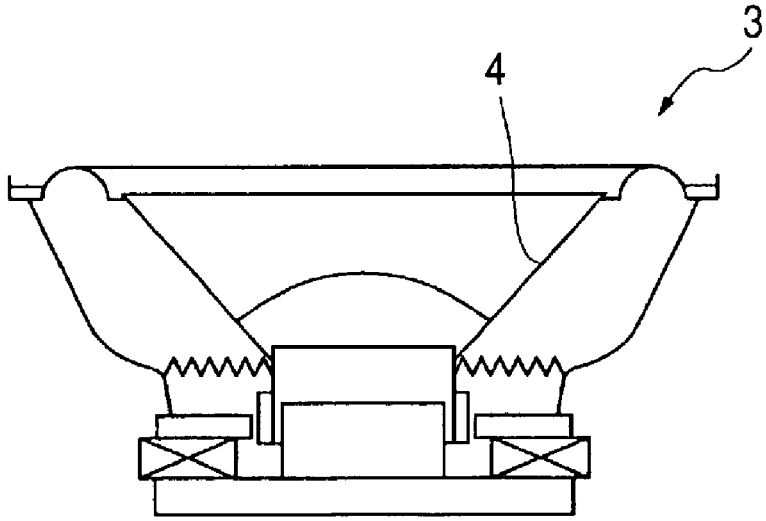
Figure 7:
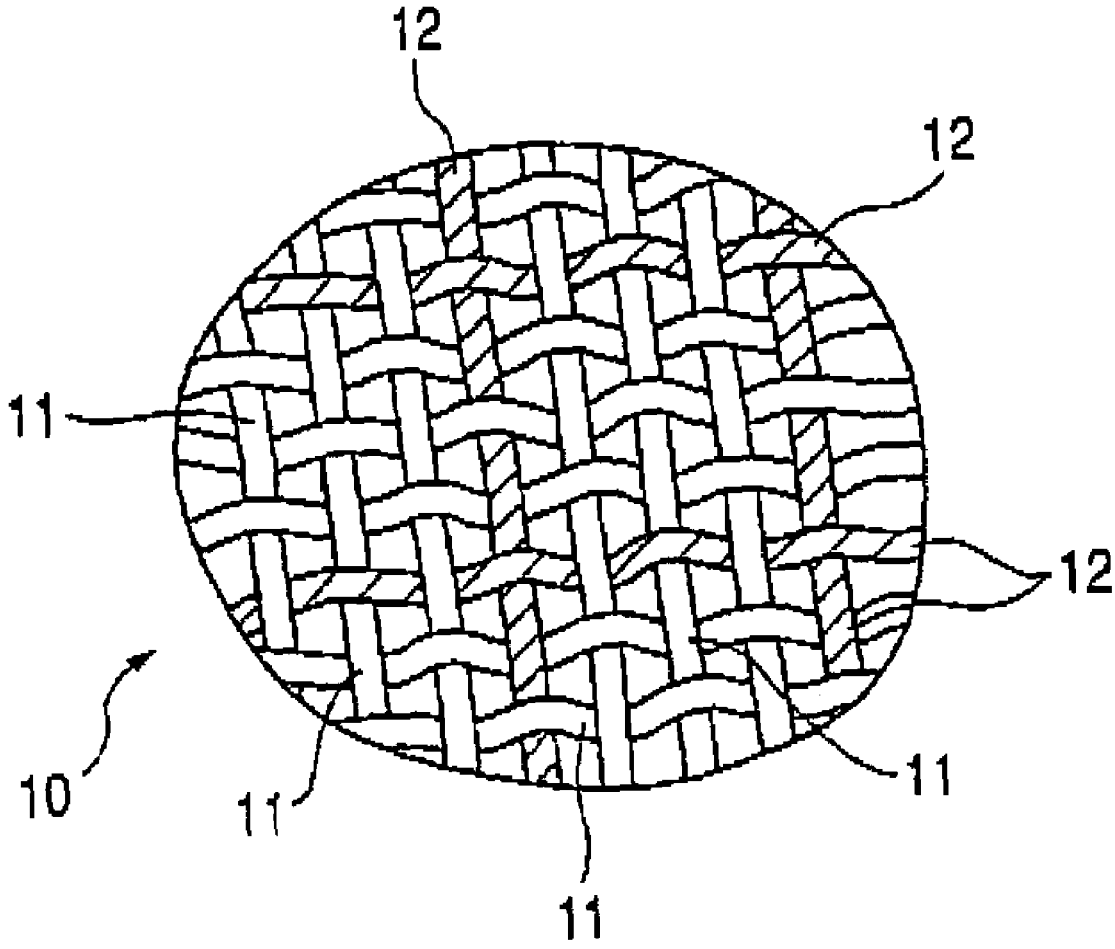
FIG. 7 PRIOR ART
FIG. 7 is a partial enlarged view showing a state of the woven fabric for conventional loud-speaker diaphragm.

When, as shown in FIG. 6, the above described woven fabric is used on the surface of the diaphragm 4 of the loud-speaker, the color of the diaphragm 4 of the loud-speaker is the color of this woven fabric. In this way here is obtained the diaphragm 4 with even and beautiful color and with a uniformly high tensile strength. In addition, if monofilaments 1 and 2 colored beforehand are used, an effect of an omission of the dyeing process may also be expected.

The diaphragm 4 for the loud-speaker using the above described woven fabric for the loud-speaker diaphragm is installed in the main body of the loud-speaker 3. When the loud-speaker is observed from the front, the color of the diaphragm 4 for the loud-speaker is observed as the color of the loud-speaker 3. The diaphragm 4 for the loud-speaker has a beautiful color tone without the lattice pattern or an irregularity, and as a result the whole appearance of the loud-speaker 3 is improved.

The above described embodiment is an example of preferred description of the embodiment of the present invention without providing any limitation to the invention, and various modifications and applications may occur without departing from the spirit and scope of the invention. For example, weaving threads constituting a woven fabric for the loud-speaker diaphragm may be a ply yarn 6 as shown in (A) and (B) of FIG. 2. The ply yarn 6 comprises several PBO fibers 1 and several polyester fibers 2, colored or not colored, that are plied together. When the colored polyester fiber 2 is employed the same as twisted yarn 5, this color is observed as the color of the ply yarn 6.

In addition, weaving thread constituting the woven fabric for a loud-speaker diaphragm may have a configuration such as core yarn. In this core yarn 7, as indicated in FIG. 3, a PBO fiber 1 is placed, as a core thread, in a central position, and the colored polyester fiber 2 is placed to cover the core thread in a part of a sheath surrounding the core thread.

In addition, the weaving threads may be a covered yarn 8. The covered yarn 8 has a structure, as shown in FIG. 4, in which a core thread of PBO fiber 1 is placed and the core thread is then covered by the polyester fiber 2 that winds up around the core thread the same as the core yarn 7. In the case of the above described core yarn 7 and this covered yarn 8, a color selection may be made more flexible, because the color of PBO fiber 1 is hidden.

In addition, weaving threads making up a woven fabric for a loud-speaker diaphragm may be an intermingled yarn 9 as shown in FIG. 5. This intermingled yarn 9 is formed by intermingling the PBO fibers 1 alone or both the PBO fibers 1 and the polyester fibers 2 through an air flow nozzle.

In the case of the above described core yarn 7, the covered yarn 8 or the intermingled yarn 9, the PBO fiber 1 that is difficult to be colored is placed or combined as a core thread in the center to introduce an easily colorable polyester fiber 2 (a staple fiber in case of a core yarn) around the core thread. Accordingly, when the fabric after woven is dyed, the polyester fiber 2 is dyed enough, and as a result the color of the PBO fiber 1 that is difficult to be colored becomes less visible. And in addition, when the polyester fiber 2 which has been colored beforehand is used, the color of the polyester fiber 2 which had been already colored is observed as the color of the woven fabric for the loud-speaker diaphragm after woven. Thus in both cases where the polyester fiber 2 is not colored beforehand and the fabric is dyed after woven, and where the colored polyester fiber 2 is woven into fabric and the dyeing process is omitted, a beautiful and uniform color may be shown on the fabric without any lattice pattern or an irregularity.

In addition, in the preferred embodiment of the present invention the threads used for the woven fabric for the loud-speaker diaphragm are made up of comprise the PBO fiber 1 and the polyester fiber 2, but any other synthetic fibers. For example, the combinations of a polypropylene fiber and the PBO fiber 1, or the polyester fiber 2, the polypropylene fiber and the PBO fiber 1 may also be used. And moreover, other fibers for increasing the tensile strength may be employed instead of PBO fiber 1 or only fibers of the plural kinds without the fiber for increasing the tensile strength may be employed to constitute the thread.

By using monofilament not colored beforehand as multifilament used for threads of the woven fabric instead of using the fiber colored beforehand, the dyeing process may be performed after the fabric is woven, or after the fabric is incorporated in the diaphragm 4 for the loud-speaker.

INDUSTRIAL APPLICABILITY

As discussed in detail above, in the woven fabric for the loud-speaker diaphragm, the diaphragm for the loud-speaker and the loud-speaker of the present invention, the lattice pattern is not observed in the fabric after dyed because the threads used for the woven fabric comprise combined fibers of plural kinds. In addition, as a whole, a surface with a uniform tone of color is obtained even if a colored fiber is partially employed.

In addition, because the twisted yarn, the ply yarn, the core yarn, the covered yarn or an intermingled yarn is employed, the increase in tensile strength may be expected and at the same time formation of the lattice pattern after dyed may be suppressed. Furthermore, if PBO fiber is mixed, an effect of a whole and average, not partial, increase in tensile strength is expected, because PBO fiber has a characteristic having an extremely high tensile strength.

Furthermore, when other fiber in itself is colored beforehand and is woven along with another fiber such as PBO fiber, a colored woven fabric is provided, and as a result an operation procedure may be simplified because of omission of a dyeing process after woven. And overall uniform coloration is achieved without any lattice pattern.

The invention claimed is:

1. A diaphragm for loud-speaker, which uses a woven fabric for loud-speaker in at least a portion of the diaphragm, the woven fabric for loud-speaker diaphragm using a woven fabric woven with a thread comprising fibers of plural kinds, characterized in that at least one of said fibers of the plural kinds is a fiber composed of PBO (poly(p-phenylene benzobisoxazole)) fiber and at least another one of said fibers of the plural kinds is a fiber colored with dyes or pigments.

2. A loud-speaker comprising a loud-speaker diaphragm, wherein the loud-speaker diaphragm is made up of a woven fabric for loud-speaker diaphragm, the woven fabric for loud speaker diaphragm using a woven fabric woven with a thread comprising fibers of plural kinds, characterized in that at least one of said fibers of the plural kinds is a fiber composed of PBO (poly(p-phenylene benzobisoxazole)) fiber and at least another one of said fibers of the plural kinds is a fiber colored with dyes or pigments.

3. A diaphragm for a loud-speaker comprising a woven fabric woven with a thread comprising fibers of plural kinds, characterized in that at least one of said fibers of the plural kinds is a fiber composed of PBO (poly(p-phenylene benzobisoxazole)) fiber and at least another one of said fibers of the plural kinds is a fiber colored with dyes or pigments.

4. A loud-speaker comprising a diaphragm, a portion of the diaphragm comprising a woven fabric woven with a thread comprising fibers of plural kinds, characterized in that at least one of said fibers of the plural kinds is a fiber composed of PBO (poly(p-phenylene benzobisoxazole)) fiber and at least another one of said fibers of the plural kinds is a fiber colored with dyes or pigments.

* * * * *